United States Patent [19]

Holmes et al.

[11] Patent Number: 4,793,415

[45] Date of Patent: Dec. 27, 1988

[54] METHOD OF RECOVERING OIL FROM HEAVY OIL RESERVOIRS

[75] Inventors: Billy G. Holmes, Lancaster; Stevan L. Weber, Allen, both of Tex.

[73] Assignee: Mobil Oil Corporation, New York, N.Y.

[21] Appl. No.: 947,140

[22] Filed: Dec. 29, 1986

[51] Int. Cl.[4] ..... E21B 43/24

[52] U.S. Cl. ..... 166/263; 166/272; 166/285; 166/292; 166/278

[58] Field of Search ..... 166/263, 272, 285, 292, 166/278

[56] References Cited

U.S. PATENT DOCUMENTS

| | | | |
|---|---|---|---|
| 3,324,946 | 6/1967 | Belknap | 166/272 X |
| 3,682,244 | 8/1972 | Bowman et al. | 166/272 X |
| 3,830,299 | 8/1974 | Thomeer | 166/281 X |
| 4,022,280 | 5/1977 | Stoddard et al. | 166/272 |
| 4,026,359 | 5/1977 | Closmann | 166/263 |
| 4,157,116 | 6/1979 | Coulter | 166/281 X |
| 4,184,549 | 1/1980 | Schievelbein | 166/272 X |
| 4,458,758 | 7/1984 | Hunt, III et al. | 166/272 |
| 4,601,338 | 7/1986 | Prats et al. | 166/278 |
| 4,620,594 | 11/1986 | Hall | 166/263 |

*Primary Examiner*—George A. Suchfield
*Attorney, Agent, or Firm*—Alexander J. McKillop; Michael G. Gilman; Stanislaus Aksman

[57] ABSTRACT

A steam flooding method for recovering oil from an underground formation penetrated by an injection and at least one production well is modified by initially lowering the permeability of the lower vertical portion of the formation, e.g., by plugging thereof with gravel sand pack, capped by a plaster of paris or cement, thereafter continuing to inject the steam into the injection well and maintaining high level of production from the production well until thermal breakthrough is achieved in the production well. Subsequently, the initial permeability of the lower vertical portion of the formation is restored, e.g., by removing the gravel sand pack, and oil is recovered from the production well. In a preferred embodiment, the permeability of substantially the entire initial completed interval of the production well is decreased in the aforementioned manner, the well is recompleted higher in the formation and steam is continuously injected into the injection well. Subsequently, the secondary completed interval is plugged, and the permeability of the primary completed interval is restored substantially to its original level. The method of the invention decreases the time necessary for thermal breakthrough in the production well, thereby accelerating thermal communication between the injection and the production wells and improving vertical sweep efficiency of the cyclic steam or steam flooding methods of heavy oil recovery.

21 Claims, 1 Drawing Sheet

METHOD OF RECOVERING OIL FROM HEAVY OIL RESERVOIRS

BACKGROUND OF THE INVENTION

I. Field of the Invention

The invention is directed to an improved method of recovering viscous oil from a subterranean oil formation wherein it is difficult to establish thermal communication between the injection and the production wells.

II. Description of the Prior Art

Many oil reservoirs, such as heavy oil or tar sand formations, exist which contain vast quantities of oil not amenable to recovery by conventional methods because the oil is so viscous that it is substantially immobilized at reservoir conditions. Therefore, some form of supplemental oil recovery must be used in such formations to sufficiently decrease the viscosity of the oil to allow it to flow through the formation to the production well and then to the surface of the earth. Thermal recovery methods decrease the viscosity of such oil and are therefore suitable for stimulating the recovery thereof.

Steam has been utilized in the past for thermal stimulation of viscous oil in steam drive or steam flooding processes in which steam is injected into the formation on a substantially continuous basis through an injection well, and the oil, having reduced viscosity, is recovered from the formation through a spaced-apart production well. The mechanism of the oil production by steam flooding is believed to involve the condensation of the steam upon contact with cooler formation fluids including the viscous oil, thereby reducing the viscosity of the oil and allowing it to flow more easily. The establishment of thermal communication between the injection and the production wells in such steam-flooding processes is essential for achieving increased oil recovery. In most formations subjected to steam flooding, the injection of steam through the injection well combined with steam stimulation of production wells produces sufficient thermal communication between the injection and the production wells within a reasonable time period to provide a sufficiently increased production of oil from the formation.

The injection and the production wells are normally arranged in patterns where well spacing is small, ranging from about 1.25 to about 5 acres, depending upon formation thickness and steam generation capacity.

While it is relatively easy to establish thermal communication between the injection well and production wells which are subjected to the action of steam from more than one injection well, it is relatively difficult to establish thermal communication with at least some wells that are subjected to the action of steam from only one direction, i.e., outer-ring wells. Unless thermal communication is established between the injection well and a cold, e.g., less than 200° F., production well, the production of oil from such wells is not enhanced by steam flooding and, therefore, steam flooding is not utilized to its fullest potential.

Accordingly, it is a primary object of the present invention to provide an improved method of recovering viscous oil by steam flooding of a relatively heavy oil-containing reservoir.

It is an additional object of the invention to provide an improved method of providing thermal communication and thermal breakthrough between the injection well and all of the production wells in the formation.

These and other objects of the invention will become apparent to those skilled in the art from the following description thereof.

SUMMARY OF THE INVENTION

A method of recovering oil from an underground oil formation is improved by initially establishing thermal communication between the injection well and the production well or wells which are not otherwise amenable to establishing thermal communication with the injection well. The thermal communication can be established by two methods. The first method comprises lowering the permeability of the lower vertical portion of the production well by at least an order of magnitude of the initial permeability thereof, sealing the lower vertical portion of the production well from the upper portion of the completed interval, subsequently injecting steam into the injection well until thermal communication is established between the injection and the production wells, as evidenced by a steam breakthrough, and then increasing the permeability of the lower vertical portion of the production well substantially to the level of the initial permeability thereof. Thereafter, the steam injection is continued and the oil is recovered from the production well. The permeability of the lower vertical portion of the injection well is decreased by any conventional means, for example, by inserting a temporary plug into the lower vertical portion of the formation which can be subsequently removed to increase the permeability thereof.

The second and preferred method comprises lowering the permeability of substantially the entire completed interval of the production well, i.e., of substantially the entire vertical height of the production well which produces the oil, hereinafter the "initial completed interval," by at least an order of magnitude of the initial permeability thereof, e.g., by plugging it; recompleting the production well at a higher vertical distance in the formation than its original completed interval, hereinafter the "secondary completed interval"; subsequently injecting steam into the injection well until thermal communication is established between the injection and the production wells, as evidenced by steam breakthrough, in the secondary completed interval; plugging the secondary completed interval; and then recompleting the initial completed interval to restore the permeability thereof to substantially the level of the initial permeability thereof.

DETAILED DESCRIPTION OF THE INVENTION

Figure 1:
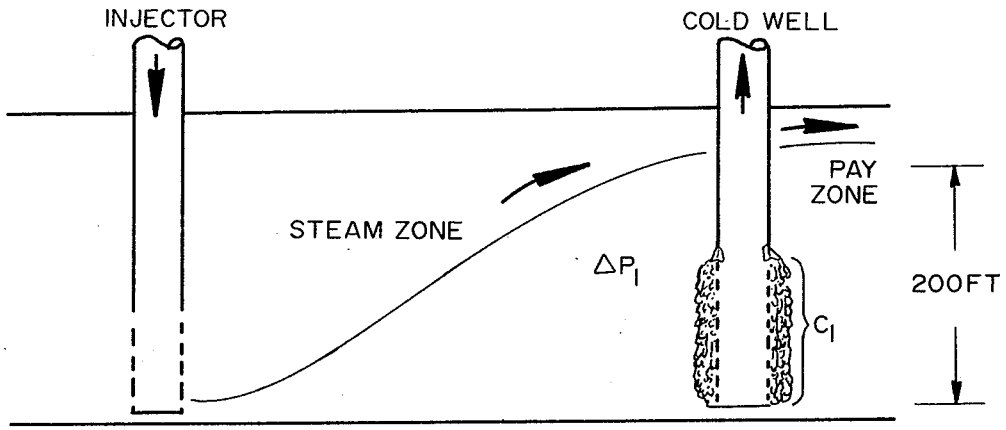
FIGS. 1 and 2 are schematic illustrations of the embodiment of the invention exemplified in Example 2.

The production well or wells which are subjected to the improvement of the present invention are any wells which are not amenable to establishing thermal communication with the injection well in a conventional manner, as evidenced, for example, by the lack of thermal communication between the injection and such a production well or wells after the injection of steam has been conducted for such a period of time that steam breakthrough has occurred in other wells. Since the outer-ring wells placed on the outer periphery of any pattern formation are most difficult to establish thermal communication with, such wells are preferably used in the method of the invention. In this connection, the term "outer-ring well" designates a production well which is subjected to the action of the injected steam from only one of three injection wells, also known as an injector. As is known to those skilled in the art, production wells are classified into three classes: inner, middle and outer-ring production wells. The inner-ring production wells are those which receive steam from about a 360° radius surrounding the well, i.e., usually from three injectors. The middle-ring production wells receive steam from a radius of about 240°, i.e., usually from two injectors. The outer-ring production wells receive steam from a radius of about 120°, i.e., usually from one injector.

The lower vertical portion of the production well whose permeability is reduced is about 30 to about 60%, preferably about 40 to about 60%, and most preferably about 50% of that portion of the lower vertical distance of the production well which penetrates the oil formation (the oil "pay zone"). The term "lower vertical distance of the production well", designates the portion of the production well measured from the lowest portion of the well in communication with the oil formation in an upward direction to the top of the portion of the production well in communication with the oil formation. Therefore, for example, if the bottom 100 feet of a 200 foot well is in communication with the oil formation, 50% of the lower vertical portion of the production well is 50 feet measured upwardly from the bottom of the well.

The permeability of that portion of the production well is decreased to at least about 1.5% to about 10%, preferably about 1.5% to about 5%, and most preferably about 1.5% to about 2% of the initial permeability thereof. The permeability is decreased in any conventional manner, for example, by introducing a temporary plug into the lower vertical portion of the production well. A convenient, and preferred manner of decreasing the permeability is by filling the desired bottom portion of the formation with a typical gravel sand pack and setting a temporary plug, such as a cement, or plaster of paris (Cal Seal) plug, available from various service companies, on top of the gravel sand pack. After the permeability of the lower portion of the production well is decreased in the aforementioned manner, steam is continuously injected through the injection well at the rate dictated by the conditions of the formation, e.g., at about 1.5 to about 2.0 barrels per day per acre-foot (BPD/Ac-ft). Simultaneously, high production rates equivalent to those normally used to recover the oil from the given formation are maintained at the production well subjected to the method of the invention. The production rates are substantially constant throughout the operation of the method of the invention. When the steam breakthrough occurs at the production well, as evidenced by high steam volumes and low oil production rates, and the temperatures in the production well are at least about 170° F., preferably at least about 200° F., the permeability of the production well is restored substantially to the original permeability thereof. Thus, for example, if the original permeability of the production well was about 7 darcys and it was decreased to about 100 to about 600 milidarcys (md), it is restored in this step of the invention to about 7 darcys. The permeability can be restored by any conventional means, such as, for example, by removing the gravel pack capped with the plaster of paris or cement from the bottom of the production well. The gravel pack can be removed by any conventional means, such as by bailing it.

In the preferred embodiment of the invention, the permeability of substantially the entire initial completed interval of the formation is decreased in any conventional manner specified above, e.g., by introducing a temporary plug into the initial completed interval, to at least about 1.5 to about 10, preferably about 1.5 to about 5, and most preferably to about 1.5 to about 2% of the initial permeability thereof. Subsequently, the well is recompleted at a vertical distance in the formation which is above the initial completed interval, i.e., in the secondary completed interval. The secondary completed interval is preferably located immediately above the initial completed interval and is adjacent to the upper boundary of the initial completed interval. However, the secondary completed interval need not be adjacent to the initial completed interval, so long as it is located physically above it. Steam is continuously injected through the injection well until steam breakthrough occurs at the production well in accordance with the invention. Subsequently, the secondary completed interval is plugged, and the initial completed interval is recompleted by any conventional means to restore the permeability thereof to substantially the level of the initial permeability thereof. The permeability is restored by any conventional means, as specified above.

The injection of steam may or may not be interruped when the permeability of the production well is restored to its original permeability. After the permeability is restored to the desired level, the steam is continuously injected into the formation at substantially the same rate as throughout the process of the invention and the oil is recovered from the production well. The rate of steam injection will depend on the particular formation conditions, as will be apparent to those skilled in the art. The steam used in all of the steps of the method of the invention has the temperature of about 400° F. to about 600° F. and a quality of about 60 to about 80%.

The method of the invention can be conducted with any pattern of injection and production wells. Without wishing to be bound by any theory of operability, it is believed that the decrease of the permeability of the lower vertical distance or of the initial completed interval of the production well increases the pressure differential between the oil reservoir pressure and the wellbore pressure (referred to in the art as "pressure drawdown"), thereby providing increased driving force for steam breakthrough.

The following Examples further illustrate the essential features of the invention. However, it will be apparent to those skilled in the art that the specific reactants and reaction conditions used in the Examples do not limit the scope of the invention.

EXAMPLE 1

In this example, a computer-simulation study was conducted to determine the effect of modifying a production well in an existing steamflood project.

The initial permeability of the formation is 7 darcy. The permeability of the lower portion of the production well is decreased to about 100 milidarcy (md) by packing the lower 40 feet of the 80 feet height of the production well in the pay zone with a typical gravel sand pack and setting a Cal-Seal plug on top of the gravel sand pack. Steam is continuously injected into the injection well at the rate of about 1.5 to about 2.0 BPD/Ac-ft and high production rates averaging between about 2,000 and about 2,500 barrels of fluid per day (BFPD) are maintained to take full advantage of the decreased permeability values in the bottom of the wellbore in an effort to increase the pressure differential (drawdown) higher in the formation. When heat breakthrough is established, as evidenced by high steam rates, and low oil rates, the plug is broken and the sand removed from the bottom of the production well. This is necessary to achieve the maximum vertical sweep efficiency possible and optimize cumulative oil recovery. In this connection, the term "vertical sweep efficiency" designates the total vertical depth from top of pay zone that the steam sweeps. For example, if steam sweeps the top 100ft zone, the vertical sweep efficiency is 50%.

EXAMPLE 2

Figure 2:
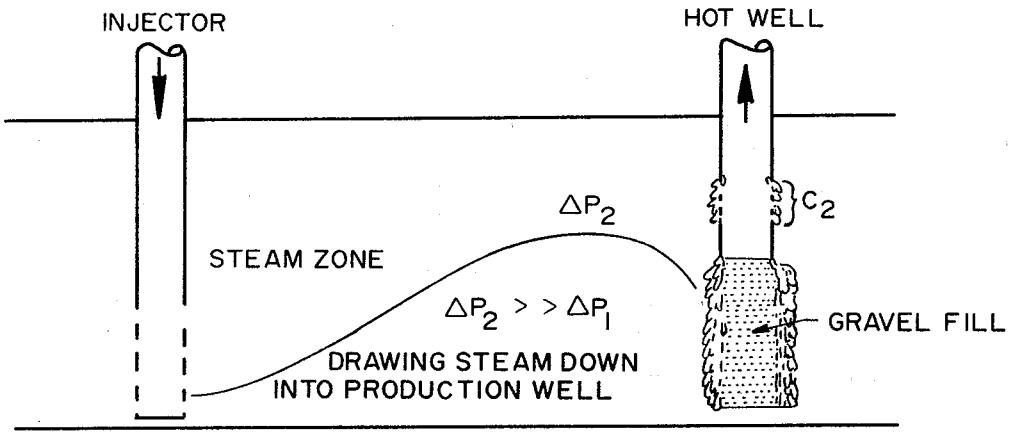

In this example, an existing production well was modified in accordance with this invention. This outer ring well in a 7-acre, 7-spot pattern remained a cold well (i.e., no steam breakthrough was observed) in spite of continuing steam injection through the injection well for several years. The well was in an oil formation having vertical thickness (pay zone) of about 200 feet (ft). The pay zone was beneath 2000 feet of soil. The well had originally been perforated in the lowest 80 feet thereof (region $C_1$, in FIG. 1). This well was modified in accordance with this invention by plugging the entire 80 foot distance with gravel pack and capping it with a cement plug. The procedure was designed to allow the return of the lower portion (the initial 80 ft perforated interval) of the well to oil production in the future. This could be done, e.g., by inserting an inner casing fitting snugly against the outer casing, and subsequently recompleting the lower portion of the well, with an underreamed gravel pack. Subsequently, a vertical 40 foot distance above the region $C_1$, was perforated (region $C_2$ in FIG. 2). The steam injection was continuously conducted during and after the modification at the rate of about 2 BPD/Ac-ft. After the modification was completed, thermal communication was established within a few days, as evidenced by a temperature increase from about 160° to about 285° F. The oil production averaged about 90 barrels of oil per day (BOPD), as compared to about 20 BOPD prior to the modification of the well. When the oil production is decreased, it is contemplated that the region $C_2$ will be plugged and the region $C_1$ recompleted.

It will be apparent to those skilled in the art that the specific embodiments discussed above can be successfully repeated with ingredients equivalent to those generically or specifically set forth above and under variable process conditions.

From the foregoing specifications, one skilled in the art can readily ascertain the essential features of this invention and without departing from the spirit and scope thereof can adapt it to various diverse applications.

We claim:

1. A method of recovering oil from an underground oil formation penetrated by an injection well and at least one production well comprising steps (a) through (e), identified below, conducted sequentially in the order of steps (a) through (e):

(a) decreasing the permeability of the lower vertical portion of the production well by at least an order of magnitude of the initial permeability thereof:

(b) injecting steam into the injection well until thermal communication is established between the injection and the production wells;

(c) increasing the permeability of the lower vertical portion of the production well substantially to the level of the initial permeability thereof;

(d) continuing the steam injection; and (e) recovering the oil from the production well.

2. A method of claim 1 wherein the permeability of the lower vertical portion of the formation is decreased in said step (a) by plugging thereof.

3. A method of claim 2 wherein the permeability of the lower vertical portion of the formation is decreased in said step (a) to between about 1.5% to about 10% of the initial permeability thereof.

4. A method of claim 3 wherein the production well is an outer-ring well situated on the outer periphery of the oil formation.

5. A method of claim 4 wherein the lower vertical portion of the production well is about 30 to about 60% of the lower vertical distance of the production well.

6. A method of claim 5 wherein said step (b) is conducted until the wellhead temperature of the production well is at least about 170° F.

7. A method of claim 6 wherein said step (b) is conducted until the wellhead temperature is at least about 200° F.

8. A method of claim 7 wherein the lower vertical portion of the formation is about 40 to about 60% of the lower vertical distance of the production well.

9. A method of claim 8 wherein the lower vertical portion of the formation is about 50% of the lower vertical distance of the production well.

10. A method of recovering oil from an underground oil formation penetrated by an injection well and at least one production well, the production well comprising an initial completed interval, comprising the steps of:

(a) decreasing the permeability of the initial completed interval by at least an order of magnitude;

(b) providing a secondary completed interval in the production well above the initial completed interval;

(c) injecting steam into the injection well until thermal communication is established between the injection and the production well;

(d) plugging the secondary completed interval;

(e) restoring the permeability of the initial completed interval substantially to the level of the initial permeability thereof;

(f) continuing the steam injection; and (g) recovering the oil from the production well.

11. A method of claim 10 wherein the permeability of the initial completed interval is decreased in said step (a) by plugging thereof.

12. A method of claim 11 wherein the permeability of the initial completed interval is decreased in said step (a) to between about 1.5% to about 10% of the initial permeability thereof.

13. A method of claim 12 wherein the production well is an outer-ring well situated on the outer periphery of the oil formation.

14. A method of claim 13 wherein said step (c) is conducted until the wellhead temperature of the production well is at least about 170° F.

15. A method claim 14 wherein said step (c) is conducted until the wellhead temperature is at least about 200° F.

16. A method of claim 9 wherein the permeability of the lower vertical portion of the formation is decreased in said step (a) to between about 1.5 to about 5% of the initial permeability thereof.

17. A method of claim 16 wherein the permeability of the lower vertical portion of the formation is decreased in said step (a) to between about 1.5 to about 2% of the initial permeability thereof.

18. A method of claim 17 wherein the permeability of the lower vertical portion of the formation is decreased by filling the lower vertical portion of the formation with a gravel sand pack and setting a temporary plug above the gravel sand pack.

19. A method of claim 15 wherein the permeability of the initial completed interval is decreased in said step (a) to between about 1.5 to about 5% of the initial permeability thereof.

20. A method of claim 19 wherein the permeability of the initial completed interval is decreased in said step (a) to between about 1.5 to about 2% of the initial permeability thereof.

21. A method of claim 20 wherein the permeability of the initial completed interval is decreased by filling the lower vertical portion of the formation with a gravel sand pack and setting a temporary plug above the gravel sand pack.

* * * * *